US011279158B2

(12) United States Patent
Butinya et al.

(10) Patent No.: US 11,279,158 B2
(45) Date of Patent: Mar. 22, 2022

(54) DUMMY CARTRIDGE

(71) Applicant: HEWLETT-PACKARD DEVELOPMENT COMPANY, L.P., Spring, TX (US)

(72) Inventors: David Butinya, Sant Cugat del Valles (ES); Jose Antonio Alvarez Tapia, Sant Cugat del Valles (ES); Marc Clotet Marti, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,003

(22) PCT Filed: Mar. 8, 2018

(86) PCT No.: PCT/US2018/021570
§ 371 (c)(1),
(2) Date: Sep. 11, 2019

(87) PCT Pub. No.: WO2019/172913
PCT Pub. Date: Sep. 12, 2019

(65) Prior Publication Data

US 2020/0391528 A1 Dec. 17, 2020

(51) Int. Cl.
*B41J 29/12* (2006.01)

(52) U.S. Cl.
CPC ..... *B41J 29/12* (2013.01)

(58) Field of Classification Search
CPC ..... B41J 29/12
USPC ..... 300/693
See application file for complete search history.

(56) References Cited

U.S. PATENT DOCUMENTS

| | | | | |
|---|---|---|---|---|
| 5,367,326 | A | 11/1994 | Pond et al. | |
| 5,877,795 | A | 3/1999 | Gragg et al. | |
| 6,805,428 | B2 | 10/2004 | Otsuki | |
| 6,969,149 | B2 | 11/2005 | Eguchi et al. | |
| 8,231,198 | B1 | 7/2012 | Askeland et al. | |
| 2003/0035032 | A1* | 2/2003 | Trafton | B41J 2/1752 347/86 |
| 2007/0229625 | A1 | 10/2007 | Yano | |
| 2010/0053257 | A1* | 3/2010 | Kubo | B41J 2/17503 347/30 |
| 2010/0283822 | A1 | 11/2010 | Arnold et al. | |
| 2013/0257975 | A1 | 10/2013 | Aoyama et al. | |
| 2014/0009541 | A1* | 1/2014 | Matsuzaki | B41J 2/1752 347/86 |
| 2018/0056657 | A1* | 3/2018 | Murakami | B41J 2/17523 |
| 2018/0290455 | A1* | 10/2018 | Tanaka | B41J 2/04581 |

FOREIGN PATENT DOCUMENTS

| | | | |
|---|---|---|---|
| EP | 1284191 | A2 | 2/2003 |
| JP | 4506940 | B2 | 7/2010 |
| JP | 4644962 | B2 | 3/2011 |

* cited by examiner

*Primary Examiner* — Anthony H Nguyen
(74) *Attorney, Agent, or Firm* — HP Inc. Patent Department

(57) ABSTRACT

A dummy cartridge includes a body having an external shape dimensioned to be received in a cartridge pocket, and a handle integrated into the body, with cavities provided in the body on two opposite sides of the handle; wherein the cavities are dimensioned to allow insertion of a human thumb and/or finger on the two opposite sides of the handle for gripping the handle.

14 Claims, 5 Drawing Sheets

DUMMY CARTRIDGE

BACKGROUND

Inkjet printers, 3D printers, and plotters may include printhead cartridges, each having a printhead emitting a printing fluid and a print fluid reservoir. The printhead cartridges may be supported by a movable printer carriage that is scanned across a print medium which is advanced between scans of the printer carriage. Printhead cartridges may be combined with print fluid delivery systems having a print fluid supply located remotely from the carriage and coupled to the printhead cartridge reservoir by a flexible fluid conveying tube. A dummy cartridge may be used in place of the printhead cartridge in certain usage situations.

BRIEF DESCRIPTION OF DRAWINGS

Different examples are described with reference to the drawings.

DESCRIPTION OF EXAMPLES

Figure 1:
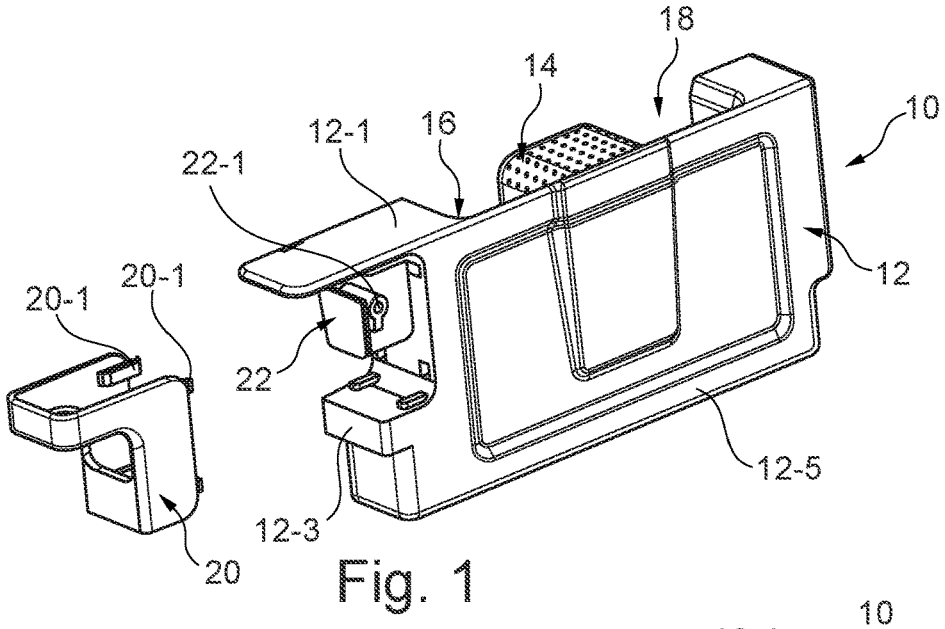
FIG. 1 shows a perspective view of a dummy cartridge and a cover, in an exploded view, according to an example.

Examples of a dummy cartridge which may be installed to replace an ink jet printhead cartridge in a printer carriage and of a method of removing the dummy cartridge from the printer carriage are described with reference to the drawings. Whereas different examples of dummy cartridges are described to comprise combinations of features, other dummy cartridges may comprise some of the described features but not necessarily all of the described features in different combinations and hence may comprise different combinations or permutations of the described features. Examples of the dummy cartridges are described in the context of an inkjet printer using operative inkjet printhead cartridges for dispensing ink or other printing fluid, for example, a fusing and/or detailing agent on a 3D printer. An operative inkjet printhead cartridge is a printhead cartridge having a printhead emitting a printing fluid. The operative inkjet printhead cartridge may have a print fluid reservoir and can be controlled by a printer controller for emitting ink or other printing fluid. In the following description, reference to "ink" is to be understood as a reference to ink and other printing fluids. The dummy cartridge may be used when one of the operative printhead cartridges is removed from the printer. The dummy cartridge may be used for protecting a cartridge pocket or for performing various maintenance or cleaning operations, as described below.

Operative inkjet printhead cartridges may be inserted in cartridge pockets provided in a printer carriage which includes hardware and electronics for ink supply and for controlling ink delivery and ejection to/from the printhead cartridges. For example, since the capacity of a printhead cartridge ink reservoir may be limited, off-axis or off-line ink delivery systems may be provided in a printer or externally to the printer wherein the ink supply is located remotely from the carriage and the printhead cartridge, and is coupled to the printhead cartridge reservoir by flexible ink conveying tubes. The ink supply, the ink conveying tubes and the printhead cartridges may form an ink supply loop for ink circulation and recirculation. The printer may further include a printer controller, communicating with a printhead cartridge through electrodes to deliver control signals to the printhead cartridge and/or read information from a semiconductor chip provided with the printhead cartridge. The semiconductor chip may include a memory for storing information such as the printhead cartridge type, date of manufacture, whether it is a recycled cartridge, time since last installation, numbers of removal and reinsertion, number of times it has fired since a last read out or a last installation, level of ink within the cartridge reservoir, etc.

A printer does not need some or all of the printhead cartridges during all times. For example, depending on the print job, some of the printhead cartridges may not be needed and keeping the printhead cartridges in the printer carriage could create waste ink because all of the printhead cartridges in a printer carriage will undergo certain servicing cycles, whether they are being used or not. If the printhead cartridges can be stored, while they are not used, and instead dummy cartridges are installed in the printer, no waste of ink is generated. As another example, if a printhead pocket should be maintained or cleaned, ink delivery tubes should be purged or, more generally, a maintenance operation is to be performed, some or all of the printhead cartridges may be removed for a certain time period. If an operative printhead cartridge is removed from the printer, it can be replaced by a dummy cartridge for protecting the cartridge pocket or for performing maintenance or cleaning operations, for example. If a dummy cartridge is installed in a cartridge pocket of the carriage, it seals the cartridge pocket and prevents aerosol entering the carriage and possibly damaging the printer electronics. A dummy cartridge may include a body having an external shape similar to an operative printhead cartridge's shape but not having ink emitting inkjet printheads or an ink reservoir.

A dummy cartridge according to an example may include a body having an external shape dimensioned to be received in a cartridge pocket, and a handle integrated into the body, with at least one cavity provided in the body along a side of the handle. In an example, two cavities can be provided in the body on two opposite sides of the handle. The one or two cavities may be dimensioned to allow insertion of a human thumb and/or finger on one side or two opposite sides of the handle for gripping the handle. In different examples, the interior handle may have an inverted L shape. In these and other examples, the interior handle may bridge two opposite side faces of the dummy cartridge. The interior handle may be shaped to be gripped in such a way that a pulling force counter acts a holding force holding the dummy cartridge within the cartridge pocket, to remove the dummy cartridge vertically or essentially vertically to avoid damage to fluid ports and electronic parts within the cartridge pocket.

For example, if the dummy cartridge is coupled to fluid supply ports of the ink conveying tubes within the printer carriage, the connection between the dummy cartridge and the fluid supplied ports may resist removal of the dummy cartridge from the cartridge pocket. The interior handle integrated in the dummy cartridge body allows gripping the dummy cartridge body to pull the dummy cartridge up and out of the cartridge pocket in a vertical or substantially vertical direction and avoid that the dummy cartridge makes a pivoting movement around the fluid supply ports which could damage the fluid supply ports or electronics or other parts within the cartridge pocket. The handle may be located at or close to the center of gravity of the body or it may be offset from the center of gravity in a direction towards the fluid supply ports. In an example, the handle may span the center of gravity of the dummy cartridge.

The dummy cartridge according to an example further may include an attachment feature for receiving an accessory device, such as a fluid interconnect bridge, to be able to circulate all of the ink in the ink delivery system no matter if an operative printhead cartridge is installed or not, an air purger for removing air in the ink supply tubes during a startup process, a closure of the fluid supply ports or the like. Circulation of ink in the ink delivery system can be used to disperse pigments and particles in ink and other fluids to maintain the homogeneity of the ink. For example, printing fluids may comprise special inks, such as white inks or other types of inks containing heavy pigments or heavy particles having a tendency to precipitate in the printer if the printing fluid is not moving. Thus, printing fluid may be circulated in the printer to reduce the possibility of printing fluid precipitation and clogging in the printer.

The dummy cartridge according to a further example may also include a chip compatible with the printer electronics for storing information, such as a version number of the dummy cartridge, whether it is an original part, the number of insertions, the type of accessory device installed or the like. This information can be used by the printer to detect that a dummy cartridge has been inserted in the cartridge pocket, that a particular accessory device is installed with the dummy cartridge, to control actions of the printer, using the dummy cartridge, such as ink recirculation, cleaning and the like.

The dummy cartridge body may be manufactured as a single part by 3D printing technology or molding from a plastic material. For the 3D printing technology, some examples of plastic materials that can be used include: polyamide, nylon, ABS, resin, and the like. For injection molding, some examples of plastic materials that can be used include: ABS or other thermoplastic polymer, POM (Polyoxymethylene), Polyetherimide or another transparent thermoplastic polymer, and the like.

Figure 2:
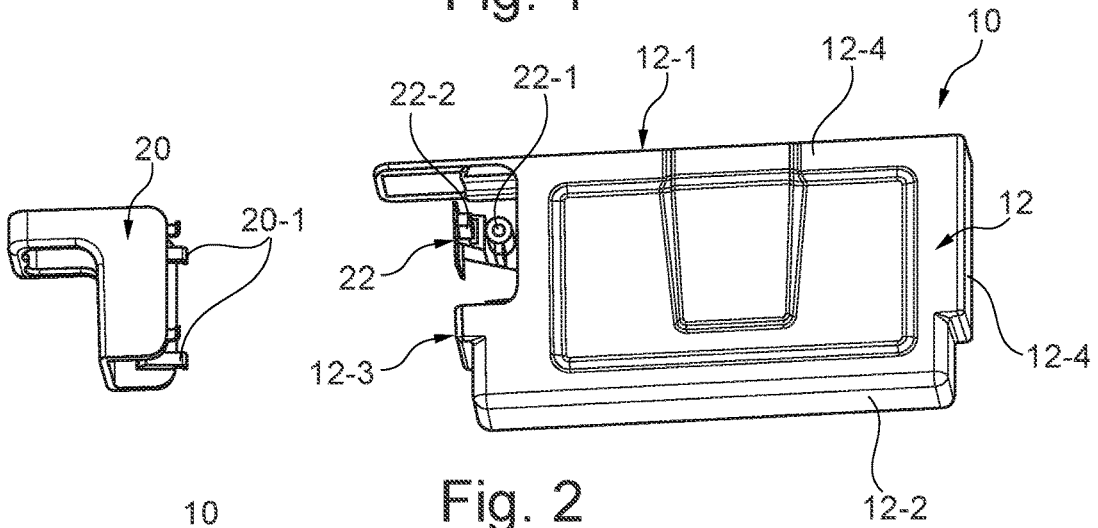
FIG. 2 shows a perspective view of the dummy cartridge and cover of FIG. 1 from a different angle.
Figure 3:
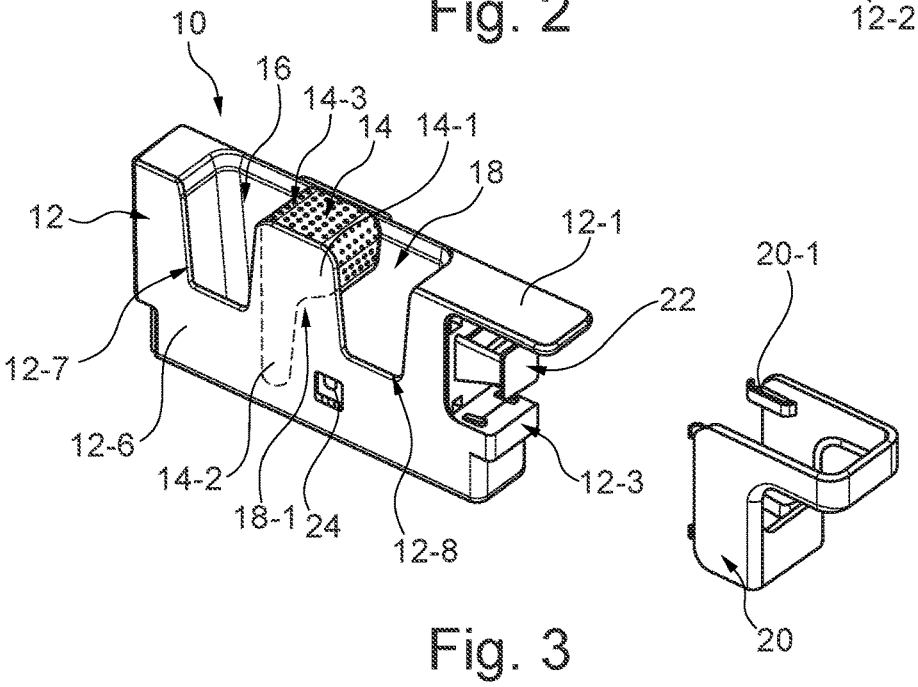
FIG. 3 shows a perspective view of the dummy cartridge and cover of FIG. 1 from the opposite side.
Figure 4:
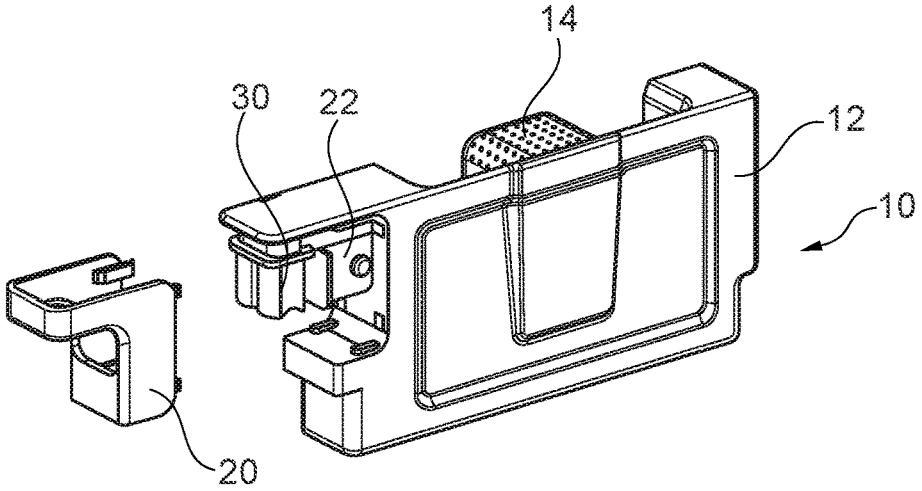
FIG. 4 shows a perspective view of the dummy cartridge and cover which is similar to the view of FIG. 1, with an accessory device according to an example attached to the dummy cartridge.
Figure 5:
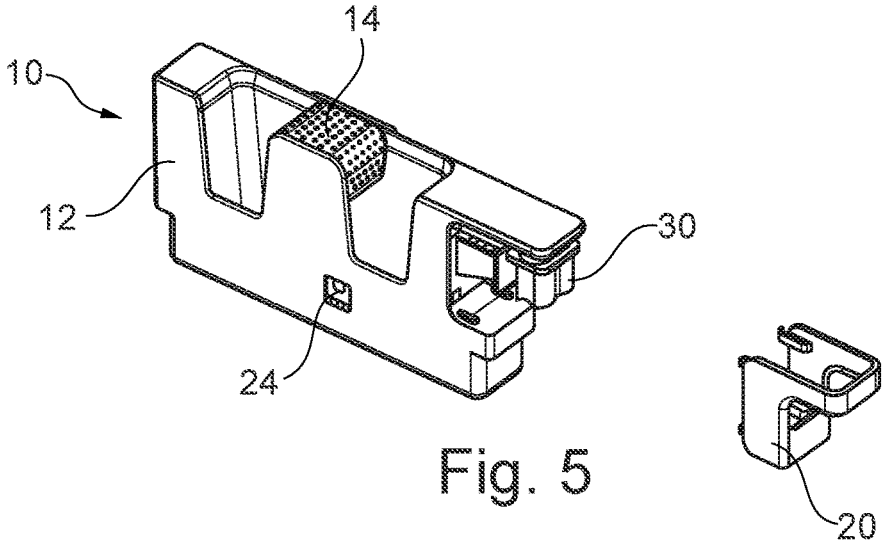
FIG. 5 shows a perspective view of the dummy cartridge and cover, with the accessory device according to an example attached to the dummy cartridge, which is similar to the view of FIG. 3.

FIGS. 1 to 3 show different perspective views of a dummy cartridge 10 and an associated cover 20 according to an example. The dummy cartridge includes a dummy cartridge body 12 which may be a single molded or 3D printed part made from a plastic material. The dummy cartridge body 12, in short the "body", has an exterior shape which corresponds to or is similar to the exterior shape of an operative printhead cartridge which is shaped to be inserted into a cartridge pocket of a printer carriage. The body 12 includes a top side 12-1 which faces upwards when the dummy cartridge 10 is inserted in a cartridge pocket; a bottom side 12-2 opposite the top side 12-2; a front side 12-3 which faces towards fluid supply ports of the printer when the dummy cartridge 10 is inserted in the cartridge pocket; a rear side 12-4 opposite the front side 12-3; and two opposite side faces 12-5, 12-6.

In the example of FIGS. 1 to 3, the dummy cartridge body 12 includes a handle 14 integrated into the dummy cartridge body 12, with cavities 16, 18 provided in the dummy cartridge body on two opposite sides of the handle 14. The cavities 16, 18 are dimensioned to allow insertion of a human thumb and/or finger on the two opposite sides of the handle for gripping the handle 14. In the example, the cavities 16, 18 are provided to the rear and to the front of the handle 14. In another example, a single cavity may be provided alongside the handle 14, such as at the front of the handle 14. The handle 14 may be located at or near the center of gravity of the body 12 or it may be offset from the center of gravity towards the front side 12-3 of the body 12 to balance a holding force of fluid supply ports connected to an accessory device of the dummy cartridge, as explained below. The handle 14 can occupy space within the body 12 of the dummy cartridge which, in an operative printhead cartridge, may be occupied by a fluid reservoir.

Figure 7:
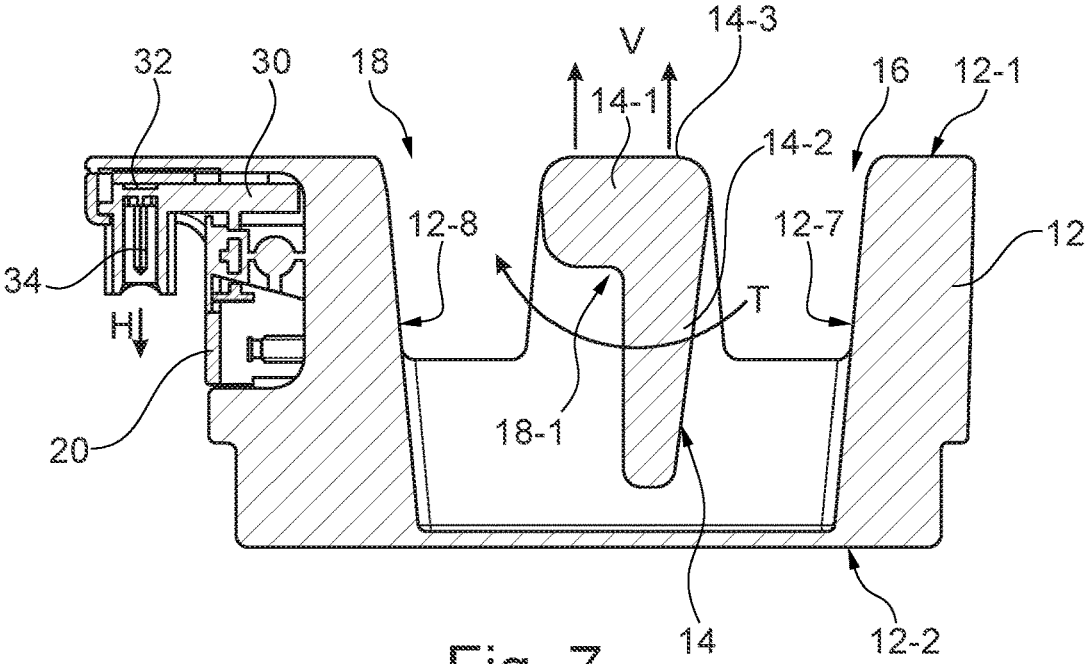
FIG. 7 shows a sectional view through the dummy cartridge, with the accessory device and the cover attached, according to an example.

The handle may be formed as a bridge between the two opposite side faces of the dummy cartridge 10 and may have an inverted "L" shape which, in FIG. 3, is illustrated by dashed lines and which can be well-recognized in the sectional view of FIG. 7. The inverted L shape of the handle 14 may include a shorter leg 14-1 and a longer leg 14-2 connected at a corner 14-3 of the L shaped handle; wherein the shorter leg 14-1 is located near the top side of the body 12 and extends from the corner 14-3 towards the front side 12-3 of the body 12, and wherein the longer leg 14-2 extends from the corner 14-3 towards the bottom side 12-2 of the body. The handle 14 and one of the cavities, such as the front cavity 18, in combination form an undercut 18-1 which can be gripped by a human finger or thumb when pulling the dummy cartridge 10 from a cartridge pocket. The cavities may extend from the top side 12-1 towards the bottom side 12-2 of the body 12 and may extend over part of or substantially the entire height of the dummy cartridge. Each of the cavities 16, 18 may have an opening at the top side 12-1 of the body 12, the opening having an area which is sufficiently big to allow insertion of a human finger or thumb.

For example, the area of the opening of the cavities 16, 18 may be in the range of 5 to 15 $cm^2$ or of about 10 $cm^2$. In one or more examples, the shorter leg 14-1 may have a thickness, measured from the top side towards the bottom side of the body 12, in the range of 1 to 2 cm or of about 1.5 cm and may have a length in the range of 1.5 to 3 cm or of about 2.5 cm. The longer leg may have a thickness, measured in a direction from the front side to the rear side of the body 12, in the range of 0.2 to 1.5 cm or of about 1 cm and may have a length in the range of 5 to 10 cm or of about 8 cm. The undercut 18-1 of the handle 14 may be located at the center of gravity or at about the center of gravity of the dummy cartridge 10, in a direction between the front side 12-3 and the rear side 12-4 of the cartridge body 12, or it may be offset from the center of gravity towards the front of the cartridge body, e.g. by about 1/10 of the length of the cartridge body from its front side to its rear side, to compensate the holding force of fluid supply ports connected to accessory device of the dummy cartridge by a relatively small torque, as explained below. The absolute dimensions and exact location will also depend on the size and shape of the dummy cartridge.

The handle further may have a structured surface, at least at the shorter leg 14-1 to provide for a nonslip surface and hence a safe grip when gripping the handle 14. The structure on the surface of the handle may be provided by an array of raised features, such as raised dots, straight or curved lines.

Figure 8:
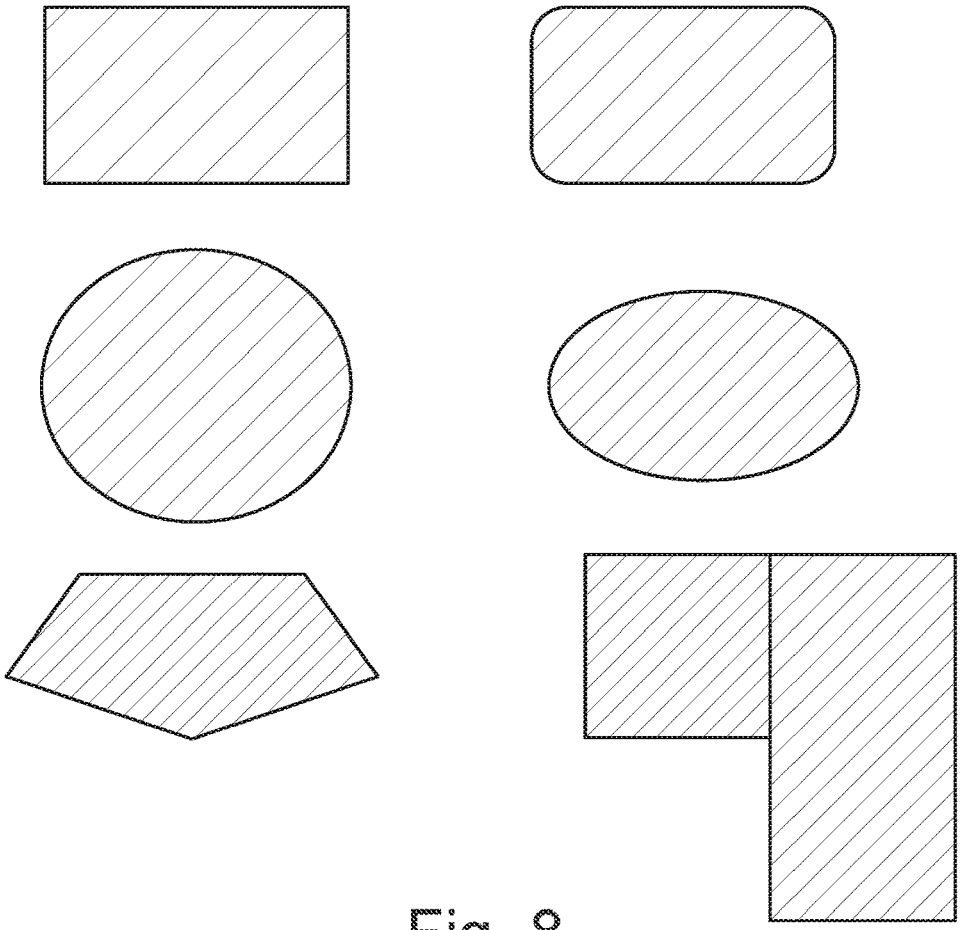
FIG. 8 shows different examples of handle cross-sections.

In a variant of this example, the rear cavity 16 may be omitted. In another variant, the handle 14 bridges the two opposite side faces 12-5, 12-6 of the cartridge body 12 but has a different shape, such as a beam-shape or cylinder shape, with two cavities to the front and to the rear of the handle or with only one cavity to the front of the handle 14. FIG. 8 shows different examples of handle cross-sections, including a rectangle, a rectangle having rounded corners, a circle, an ellipse, a polygon, and another L shape having legs of the equal or different lengths.

In the illustrated example, one of the side faces 12-5 of the body 12 is closed and provides a solid surface from the top side 12-1 to the bottom side 12-2 and from the front side 12-3 to the rear side 12-4 of the body 12. The opposite side face 12-6 of this example includes two cutouts 12-7, 12-8 extending along a part of the cavities 16, 18 to facilitate reaching into the cavities and gripping of the handle 14, e.g. between a finger and thumb of a human hand. In the illustrated example, the cutouts 12-7, 12-8 extend along about half of the depth of the cavities 16, 18, from the top side 12-1 of the dummy cartridge body 12 to about half of the height of the body 12. In other examples, both side faces 12-5 and 12-6 of the body 12 may be closed or both side faces may include similar or different cutouts.

In different examples, the body 12 further may comprise an integrated attachment feature 22 for receiving an accessory device, explained in further detail below. The attachment feature 22 may include a threaded hole 22-1 and guide structures 22-2 to receive and fix different types of dummy cartridge accessory devices.

In different examples, the dummy cartridge 10 also may include a cover 20 having a series of clips 20-1 to attach and remove the cover 20 from the dummy cartridge body 12. When the cover 20 is installed, the attachment feature 22 is hidden and protected.

In different examples, the dummy cartridge may further include a memory for storing information about at least one of the type and usage of the dummy cartridge. The memory may be integrated into a semiconductor chip 24, the semiconductor chip 24 further including a controller. An example of a semiconductor chip 24 is shown in FIG. 3 where it is located at one of the side faces 12-5 of the dummy cartridge body 12. The chip 24 may be compatible with printer electronics for communicating information, such as a version of the dummy cartridge, whether it is an original part, the number of insertions, the type of accessory device installed. This information can be used by the printer to detect that a dummy cartridge has been inserted in the cartridge pocket and to detect the type of accessory device, if any, to control actions of the printer, using the dummy cartridge, such as ink recirculation, cleaning and the like.

Figure 6:
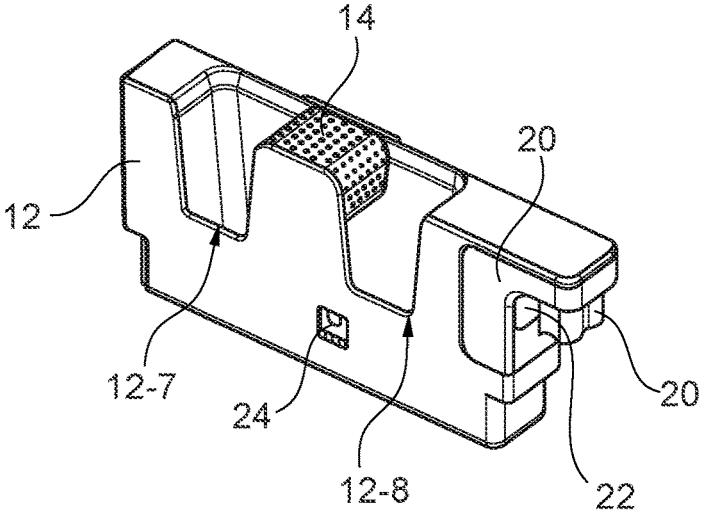
FIG. 6 shows a perspective view of the dummy cartridge, with the cover attached, which is similar to the view of FIG. 5.

FIGS. 4 to 7 show similar views as FIGS. 1 and 3 wherein an accessory device 30 is installed at the attachment feature 22 and, in FIGS. 6 and 7, the cover 20 is placed over the attachment feature 22. Regarding the shape of the cartridge body 12 and the handle 14 as well as the attachment feature 22 and the chip 24, reference is made to the description of FIGS. 1 to 3. Whereas, some of the reference numbers used in FIGS. 1 to 3 have been omitted, the same or corresponding features also can be provided in the example of FIG. 4 to 7. FIG. 7 illustrates a sectional view through a dummy cartridge 10, with an accessory device 30 installed and the cover 20 placed thereover.

The accessory device 30 of this example is a fluid interconnect bridge which may include a fluid channel 32 connecting a pair of hollow needles 34 (only one of them can be seen in the sectional view of FIG. 7), the hollow needles serving as interconnect ports for connection to fluid supply ports of a printer, as explained below. The hollow needles 34 are dimensioned to mate with respective fluid supply ports of a printer when the dummy cartridge, with the accessory device 30 attached thereto, is inserted into a cartridge pocket of the printer. The fluid interconnect bridge can be used to provide a closed loop of a fluid recirculation system, when an operative printhead cartridge is removed and replaced by the dummy cartridge including the accessory device 30. Circulating a printing fluid, such as ink, in a printer may help to keep heavy pigments or heavy particles dispersed in the printing fluid also when the printer is in an idle or standby mode between printing operations.

The accessory device 30 can be a small standard part which can be fitted to the attachment feature 22. It can be slid over the guide structures 22-2 and it can be fixed by a screw at the threaded hole 22-1, for example.

Besides the fluid interconnect bridge, also other types of accessory devices may be provided, such as an air purger for removing air in the ink supply tubes during a startup process, for example, or a foam body for closing the fluid supply ports of the printer during transport. Further examples of accessory devices are a primer which may be provided at the top side of the dummy cartridge body, or a cleaning kit including elements to clean electrodes and other electrical connections provided in the cartridge pocket.

Figure 9A:
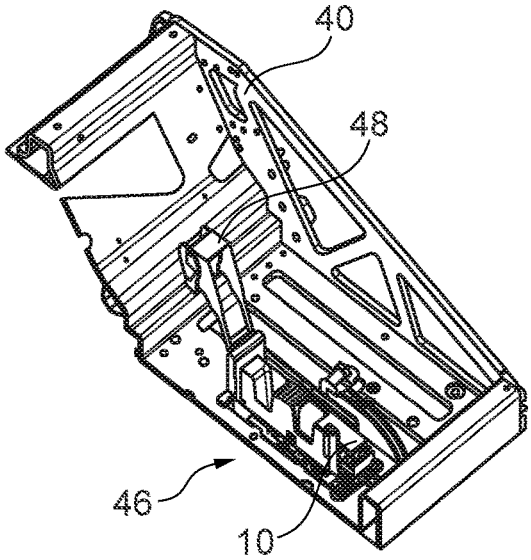
FIGS. 9A and 9B show perspective views of part of a printer carriage of an inkjet printer, including a cartridge pocket according to an example.
Figure 9B:
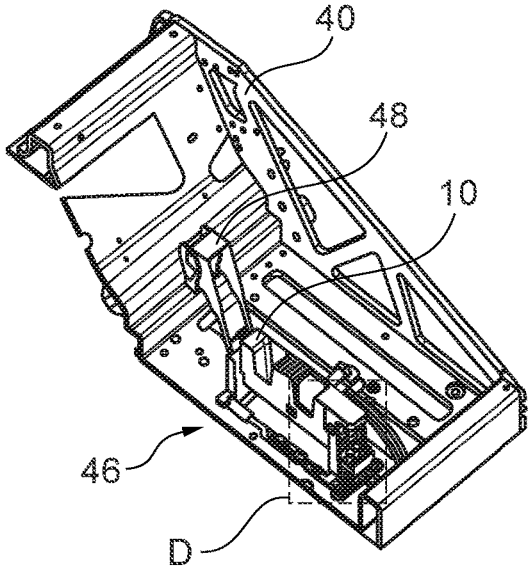
Figure 9C:
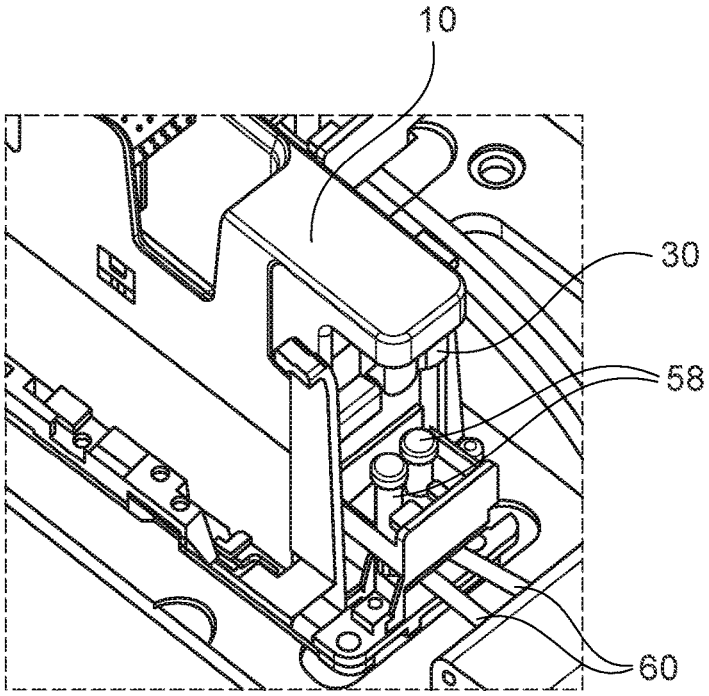
FIG. 9C shows an enlarged detail of FIG. 6B, taken at rectangle D in FIG. 6B.

FIGS. 9A and 9B show perspective views of part of a printer carriage of an inkjet printer, including a cartridge pocket according to an example. FIG. 9C shows an enlarged detail of FIG. 9B, at rectangle D in FIG. 9B. Whereas, the printer carriage 40 may include several cartridge pockets, e.g. five cartridge pockets, one of the cartridge pockets is shown at 46. Each cartridge pocket may receive an operative printhead cartridge or a dummy cartridge wherein a dummy cartridge 10 is illustrated in FIG. 9A to 9C. In FIG. 9A, the dummy cartridge 10 is fully inserted in cartridge pocket 46 and, in FIGS. 9B and 9C, the dummy cartridge 10 is partially inserted in cartridge pocket 46. The dummy cartridges 10 has an accessory device 30 mounted thereto such as the fluid interconnect bridge illustrated above. The carriage further includes a pivotable cover 48 to be closed on an operative printhead cartridge or dummy cartridge after it has been inserted into the respective cartridge pocket.

FIGS. 9B and 9C illustrate two fluid supply ports 58 connected to fluid supply tubes 60 for supplying a printing fluid to a printhead cartridge. The fluid supply ports 58 each include a septum into which a respective needle 34 of the fluid interconnect bridge may be inserted. In FIG. 9A, the dummy cartridge 10 is fully inserted so that the fluid supply ports 58 and the respective needles 34 of the fluid interconnect bridge of the accessory device 30 are engaged. In FIGS. 9B and 9C, the dummy cartridge 10 is partially inserted, wherein the fluid supply ports 58 and the respective needles 34 of the fluid interconnect bridge 30 are disengaged.

When removing the dummy cartridge 10 from the cartridge pocket 46, the engagement between the fluid supply ports 58 and the needles 34, which in combination are referred to as fluid interconnect, has to be released. If the dummy cartridge 10 had been inserted in the cartridge pocket for some time, it may happen that the engagement of the fluid interconnect is enforced by dried or partly dried ink. Therefore, when pulling the dummy cartridge 10 from the cartridge pocket the needles 34 of the fluid interconnect bridge may create a holding force in the opposite direction which has to be overcome. When the dummy cartridge is removed, there is a risk that the dummy cartridge tilts or pivots around the fluid supply ports 58 and needles 34 which could damage the fluid interconnect or electronics of the printer.

The handle design prevents such a pivoting or tilting movement and ensures that the dummy cartridge is removed substantially or completely vertically. The inverted L-shaped handle 14 is designed such that a e.g. human thumb may be placed at the undercut 18-1 under the shorter leg 14-1 of the handle in the front cavity 18, and e.g. the index finger may be placed along the rear side of the longer leg 14-2 in the rear cavity to grab the handle 14 and create a pivoting force and torque which balances the holding force of the fluid interconnect. Other handle shapes, including an undercut, may create a similar effect.

The holding force generated by the fluid interconnect is illustrated by arrow H in FIG. 7, and the torque generated by pulling on the shorter leg 14-1 of the handle 14, balancing the holding force of the fluid interconnect, is illustrated by arrow T. The resulting vertical force for removing the dummy cartridge from the cartridge pocket is illustrated by arrows V. Accordingly, the handle 14 has a shape which, intrinsically, when a user grabs the handle to remove the dummy cartridge from the cartridge pocket, creates a torque which balances the holding force of the fluid interconnects while removing the dummy cartridge. If the location of the handle 14 is centered or slightly offset to the front side 12-3 of the dummy cartridge, the torque to compensate the force created in the fluid interconnect at the front 12-3 of the dummy cartridge will be relatively low.

In one example, the dummy cartridge body 12 can be manufactured by 3D printing technology to create the dummy cartridge body 12, including the handle 14 and the undercut 18-1 in a single part, not needing any sliders or inserts. In other examples, it may be possible to manufacture the dummy cartridge body by molding, using sliders or inserts, or to assemble the dummy cartridge body from several parts. The dummy cartridge body 12, whether it is made from one part or several parts, can be formed from a plastic material, such as ABS (acrylonitrile butadiene styrene) or another thermoplastic polymer. If made from several parts, these can these can be joined by ultrasonic welding, for example.

The cutouts 12-7 and 12-8 and cavity openings may be positioned to avoid blow prime ports of the printer, which may be provided in cartridge pockets at a side or at the top of the cartridge pockets, to prime a printhead cartridge reservoir. The bottom side 12-2 of the dummy cartridge body 12 may be parallel to an undercarriage protector to cover completely the area exposed by a removed operative printhead cartridge to avoid any airflow which could affect the printing of the remaining operative printhead cartridges which are still installed in the carriage.

Figure 10:
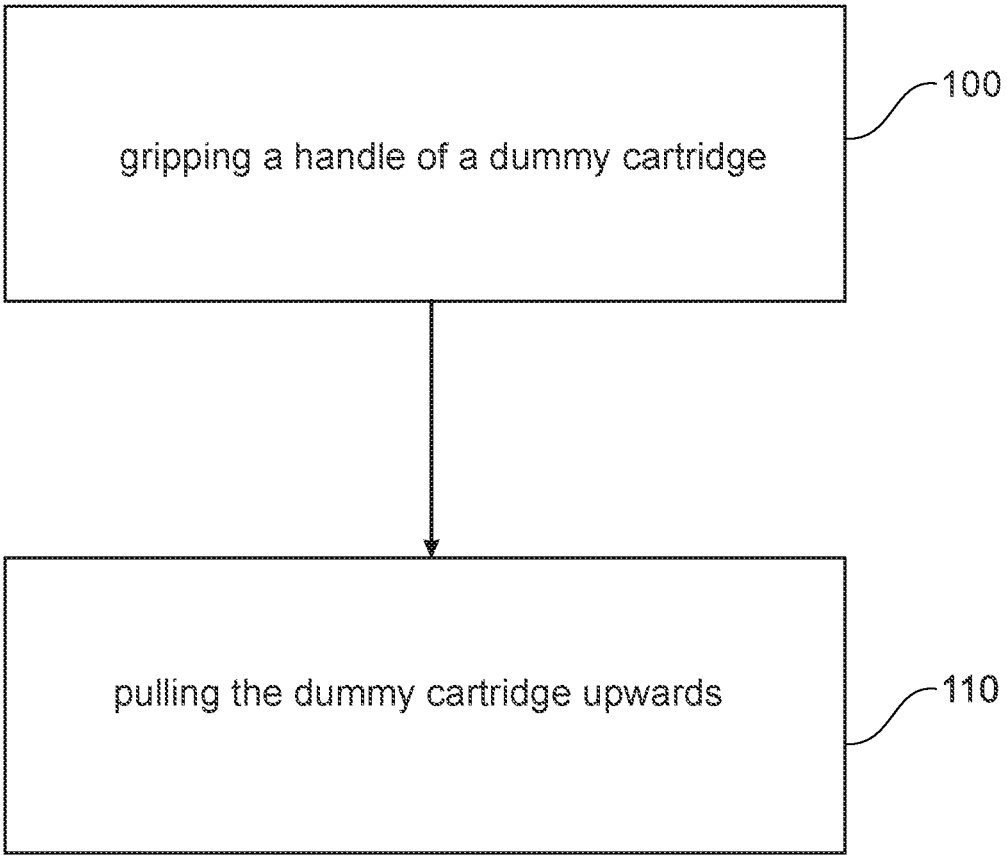
FIG. 10 shows a flow diagram of a method of removing a dummy cartridge from a printer carriage, according to an example.

In one example illustrated in FIG. 10, a dummy cartridge 10 is removed from a cartridge pocket of a printer by inserting a human finger and a human thumb into the cavities 16 and 18, with the thumb and the finger gripping the handle 14 and one of the thumb and the finger reaching below the undercut 18-1 provided by the handle 14, at 100, and pulling the dummy cartridge 10 upwards in a substantially vertical direction, at 110, wherein a pulling force generated by reaching below the undercut 18-1 vertically removes the dummy cartridge 10 avoiding or reducing a pivoting movement of the dummy cartridge 10.

What is claimed is:

1. A dummy cartridge including a body having an external shape to be received in a cartridge pocket of a printer, and a handle integrated into the body, with a cavity provided in the body on at least one side of the handle, wherein the handle has an inverted "L" shape;

wherein the cavity is dimensioned to allow insertion of a human thumb and/or finger on the side of the handle for gripping the handle.

2. The dummy cartridge of claim 1 wherein the body is a single molded or 3D printed part.

3. The dummy cartridge of claim 1 wherein the body includes a top side which faces upwards when the dummy cartridge is inserted in the cartridge pocket;

a bottom side opposite the top side;

a front side to face towards fluid supply ports of the printer when the dummy cartridge is inserted in the cartridge pocket; and a rear side opposite the front side.

4. The dummy cartridge of claim 3 wherein the handle is located at or near the center of gravity of the body or is offset from a center of gravity towards the front of the dummy cartridge.

5. The dummy cartridge of claim 3 wherein the inverted "L" shape includes a shorter leg and a longer leg connected at a corner of the inverted "L" shaped handle;

wherein the shorter leg is located near the top side of the body and extends from the corner towards the front side of the body, and wherein the longer leg extends from the corner towards the bottom side of the body.

6. The dummy cartridge of claim 5 wherein the handle and the cavity in combination from an undercut to be gripped by a human finger and/or thumb.

7. The dummy cartridge of claim 5 wherein two cavities are provided on a front side and a rear side of the handle.

8. The dummy cartridge of claim 7 wherein the cavities extend from the top side towards the bottom side of the body and each have an opening at the top side of the body, the opening having an area of 2 to 6 $cm^2$, or of about 4 $cm^2$.

9. The dummy cartridge of claim 8 wherein the shorter leg has a thickness, measured from the top side towards the bottom side of the body, in the range of 1 to 2 cm or of about 1.5 cm.

10. The dummy cartridge of claim 3 wherein the handle bridges the two opposite side faces of the body.

11. The dummy cartridge of claim 3 wherein the handle at least in part has a structured surface.

12. The dummy cartridge of claim 3 wherein the body comprises an integrated attachment feature for receiving an accessory device.

13. A method, including removing a dummy cartridge from a cartridge pocket of a printer, the dummy cartridge including a body having an external shape dimensioned to be received in the cartridge pocket, and a handle integrated into the body, with cavities provided in the body on two opposite sides of the handle, wherein the handle has an inverted "L" shape;

wherein removing the dummy cartridge from the cartridge pocket comprises:

inserting a human thumb and a human finger into the cavities, with the thumb and the finger gripping the handle and one of the thumb and the finger reaching below an undercut provided by the handle, and pulling the dummy cartridge upwards in a substantially vertical direction, wherein a pulling force generated by reaching below the undercut vertically removes the dummy cartridge avoiding or reducing a pivoting movement of the dummy cartridge.

14. A dummy cartridge, comprising a dummy cartridge body, a pair of ports, and a fluid channel connecting the pair of ports;

wherein the pair of ports is to mate with fluid feed ports of a printer when the dummy cartridge body is inserted in the printer;

wherein the dummy cartridge further comprises a handle integrated into the dummy cartridge body, with cavities provided in the dummy cartridge body on two opposite sides of the handle, wherein the handle has an inverted "L" shape;

wherein the handle and one of the cavities in combination from an undercut to be gripped by a human finger and/or thumb for gripping the handle and pulling the dummy cartridge from the cartridge pocket in a substantially vertical direction, wherein a pulling force generated by reaching below the undercut vertically removes the dummy cartridge avoiding or reducing a pivoting movement of the dummy cartridge around the fluid feed ports.

* * * * *